US006923222B2

(12) United States Patent
Gaines

(10) Patent No.: US 6,923,222 B2
(45) Date of Patent: Aug. 2, 2005

(54) APPARATUS FOR RETAINING INFLATING NEEDLES

(76) Inventor: Edgar V. Gaines, 1765 Shiloh Valley Dr., Wildwood, MO (US) 63005

( * ) Notice: Subject to any disclaimer, the term of this patent is extended or adjusted under 35 U.S.C. 154(b) by 244 days.

(21) Appl. No.: 10/252,339

(22) Filed: Sep. 23, 2002

(65) Prior Publication Data

US 2004/0055663 A1 Mar. 25, 2004

(51) Int. Cl.[7] ..... B65B 1/04
(52) U.S. Cl. ..... 141/98; 141/384; 24/3.13
(58) Field of Search ..... 141/1, 37, 38, 141/98, 382–384; 211/89.01, 70.6; 24/3.13, 3.6; 417/437; 92/58.1

(56) References Cited

U.S. PATENT DOCUMENTS 5,556,258 A * 9/1996 Lange et al. ..... 417/63
5,615,454 A * 4/1997 Contarino ..... 24/3.13
2003/0217983 A1 * 11/2003 Manix et al. ..... 211/89.01

* cited by examiner

*Primary Examiner*—Timothy L. Maust
(74) *Attorney, Agent, or Firm*—Armstrong Teasdale LLP

(57) ABSTRACT

An inflating needle assembly includes a retaining element, an inflating needle, and a retainer. The inflating needle includes a hollow shank extending from a threaded fitting. The retainer is coupled to the retaining element for securing the inflating needle to the retaining element for transportation or storage.

7 Claims, 4 Drawing Sheets

APPARATUS FOR RETAINING INFLATING NEEDLES

BACKGROUND OF THE INVENTION

This application relates generally to inflating needles and, more particularly, to methods and apparatus for retaining inflating needles.

As the popularity of sports, from professional levels through the youngest amateur levels, has risen over the years, the sales of equipment used in the associated sports has also risen. Over the years, although much of the equipment used in many of the popular sports has changed, one aspect that has not changed is the need to inflate the balls used in many sports, including, but not limited to volleyball, soccer, basketball, and football. More specifically, one piece of essential equipment to such sports is an inflating needle used to inflate the balls used in such sports.

Known inflating needles include a small needle-like shank which is hollow and is provided with a rounded end having a discharge opening adjacent thereto. An opposite upper end of the inflating needle includes an externally threaded fitting. The threaded fitting enables the inflating needle to couple to a conventional hand-operated, foot-operated, or electrically-operated inflating pump. More specifically, inflating pumps of conventional construction include a threaded end that is sized to couple to a flexible hose that includes a threaded connector. The hose threaded connector is sized to threadibly couple to a valve stem for supplying air through the valve stem assembly into an inflatable vessel, such as a bicycle tire.

Because the inflating needle must first be threadibly coupled to the hose threaded connector to inflate a ball, inflating needles are often carried to sporting events for use in inflating the balls. More specifically, because of the relative small size of such needles, people often carry the inflating needles to sporting events in their clothing pockets. However, because the inflating needle shanks are small and hollow, the shanks may be easily and undesirably bent as the needles are transported and removed from a clothing pocket, rendering the inflating needle shank useless.

To facilitate eliminating a separate inflating needle to be used, at least some known pumps are assembled such that the inflating needle is permanently attached to an end of the pump. However, because the needle extends from an end of the pump, the inflating needle shank may still become inadvertently damaged. Additionally, such pumps are limited for use with valve assemblies that accept inflating needles, and as such may be more expensive than other conventional inflating pumps.

BRIEF SUMMARY OF THE INVENTION

In one aspect of the invention, an inflating needle assembly is provided. The inflating needle assembly includes a retaining element, an inflating needle, and a retainer. The inflating needle includes a hollow shank extending from a threaded fitting. The retainer is coupled to the retaining element for securing the inflating needle to the retaining element.

In another aspect of the invention, a method for retaining an inflating needle including a hollow shank that extends from a threaded fitting is provided. The method includes coupling a retainer to a split ring element, and coupling the inflating needle to the split ring element using the retainer.

In a further aspect of the invention, a holder assembly is provided. The holder assembly includes a body and a retainer. The body is configured to retain an object having an opening extending therethrough. The retainer is coupled to the body and is configured to secure an inflating needle including a threaded end and a shank extending from the threaded end to the body.

DETAILED DESCRIPTION OF THE INVENTION

Figure 1:
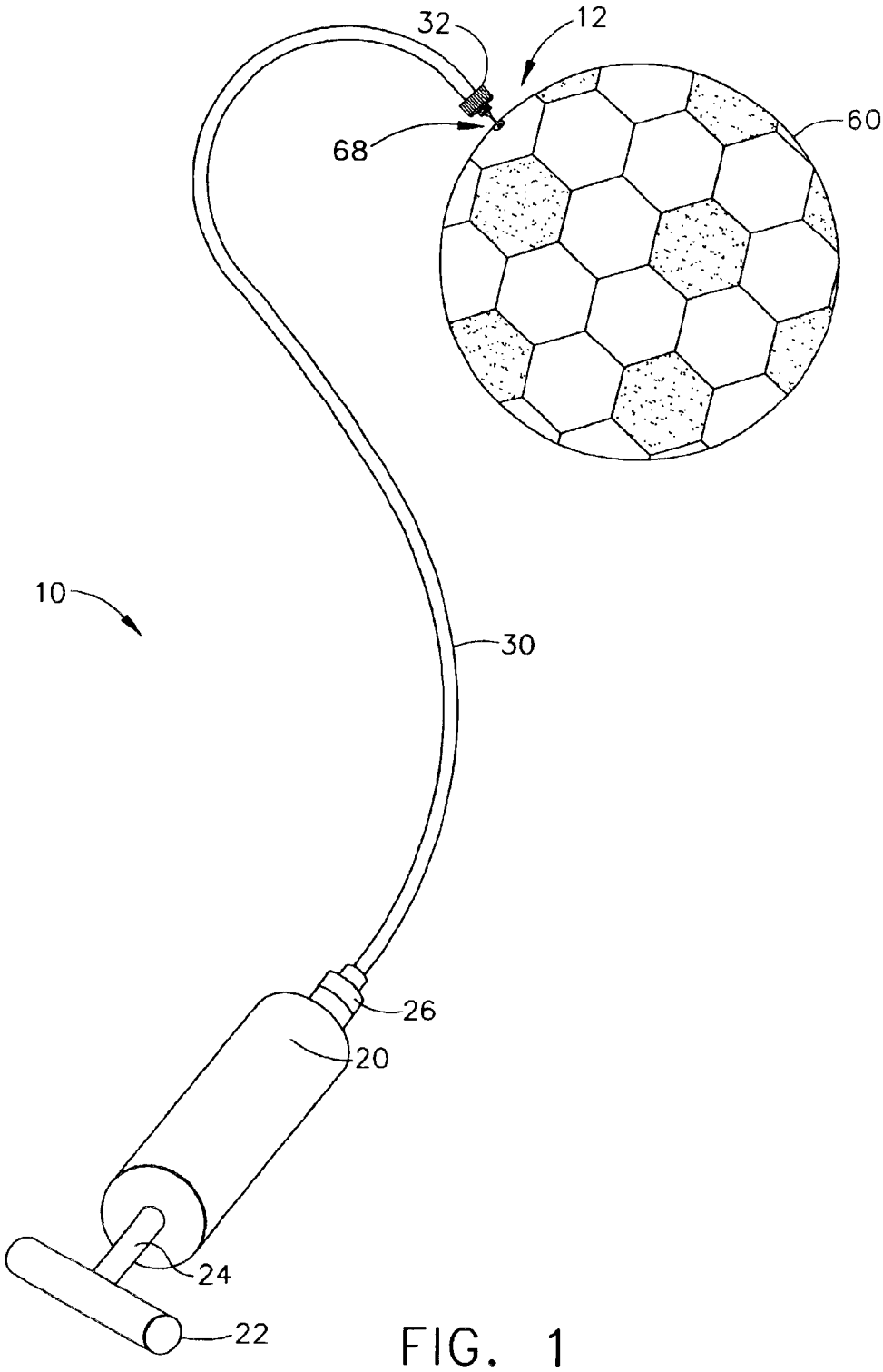
FIG. 1 is perspective view of a known hand operated inflating pump.
Figure 2:
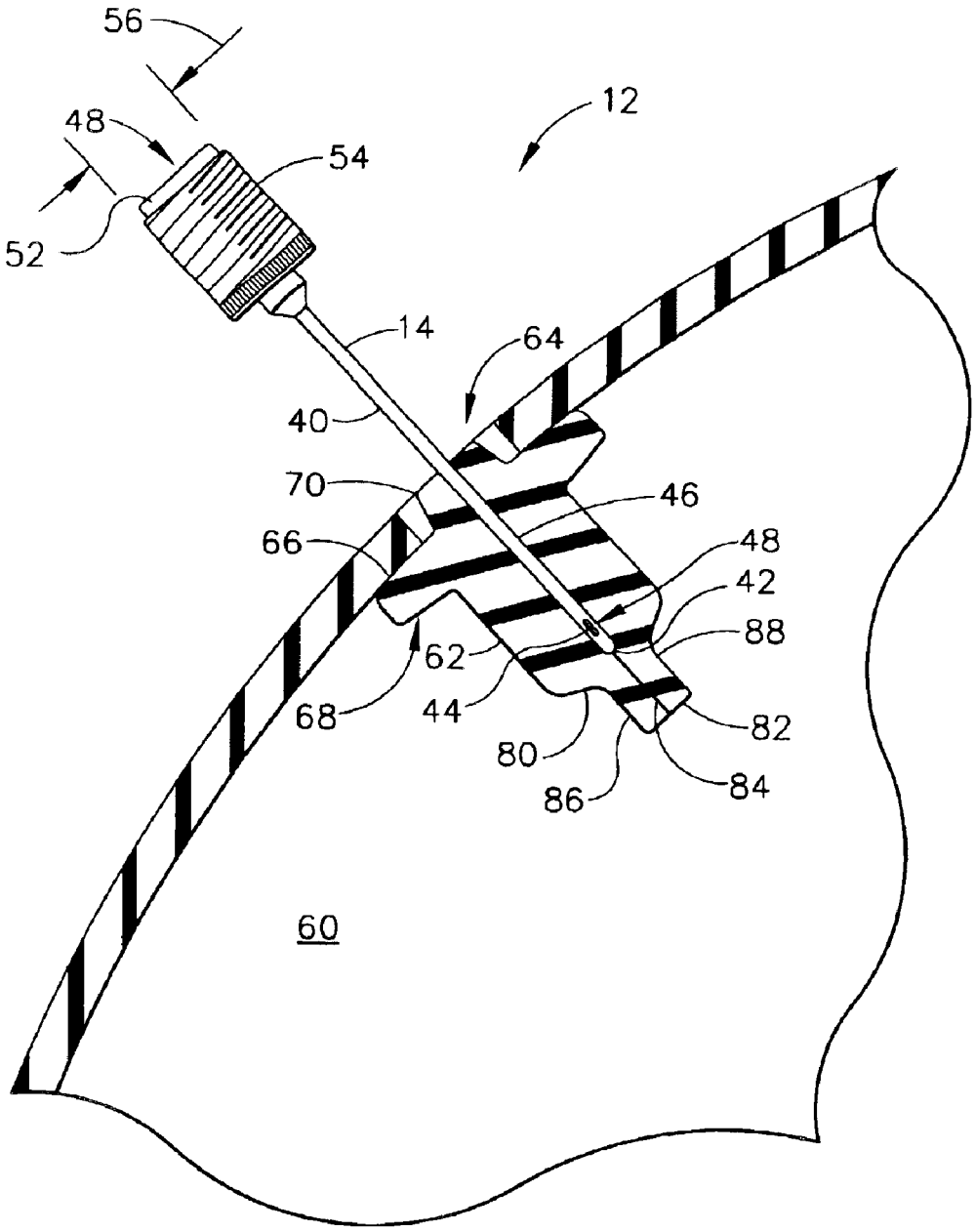
FIG. 2 is an enlarged cross-sectional view of a valve assembly including a known inflating needle extending therethrough.

FIG. 1 is perspective view of a known hand operated inflating pump 10. FIG. 2 is a cross-sectional view of a valve assembly 12 including a known inflating needle 14 extending therethrough. Pump 10 is of conventional construction and includes a cylinder 20 and a handle 22 coupled to a piston rod 24 to enable manual operation of a reciprocating piston within cylinder 20. Pump 12 also includes a threaded connector 26 for connecting pump 12 to a flexible hose 30 in a conventional manner. While a manual piston and cylinder pump has been illustrated, it should be noted that other types of pumps may be employed with valve assembly 12 including, but not limited to foot-operated pumps or electrically operated pumps.

Hose 30 includes a threaded coupling 32 sized to couple with inflating needle 14. Needle 14 is conventional in construction and includes a hollow needle-like shank 40 including a rounded terminal end 42 and a discharge opening 44 adjacent thereto. More specifically, opening 44 extends from an exterior surface 46 of shank 40 into a cavity 48 defined within shank 40. An upper end 52 of shank 40 is opposite terminal end 42 and is provided with an externally threaded fitting 54 having an outer diameter 56.

Fitting 54 enables needle 14 to couple to hose coupling 32. Inflating needle 14 is of the type employed for supplying air into an inflatable ball 60 which include valve assembly 12. Ball 60 is any inflatable ball that includes valve assembly 12, including, but not limited to, basketballs, volleyballs, or footballs. Valve assembly 12 is known and includes a generally cylindrical valve body 62 fabricated from resilient material, such as, but not limited to, molded rubber, neoprene, or plastic. An upper end 64 of body 62 includes a cylindrical flange 66 which is received in a mating recessed area 68 defined within ball 60. A cylindrical extension 70 projects axially from flange 66 and is substantially concentrically aligned with respect to flange 66.

A bottom or radially inward end 80 of valve assembly body 62 tapers inwardly to an extension 82. A passageway 84 extends from body upper end 64 to body extension 82 such that extension 82 forms two relatively pliable flaps 86 and 88. Accordingly, when air is not being supplied through passageway 84 by needle 14, flaps 86 and 88 are biased radially inward by the material used in fabricating body 62, to facilitate preventing air from undesirably escaping through passageway 84 from ball 60. In contrast, inflating needle 14 is inserted through valve body passageway 84, because body 62 is fabricated from a pliable material, body 62 and flaps 86 and 88 seal against inflating needle exterior surface 46 to facilitate preventing air from undesirably leaking through passageway 84 between valve body 62 and needle 14.

Figure 3:
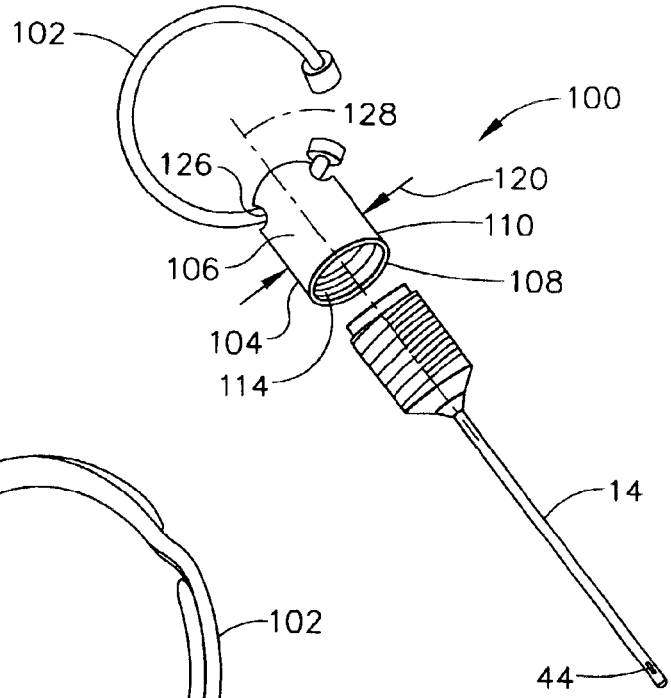
FIG. 3 is a perspective view of a retainer assembly that may be used to retain the inflating needle shown in FIG. 2.

FIG. 3 is a perspective view of a retainer assembly 100 that may be used to retain an inflating needle, such as inflating needle 14. Retainer assembly 100 includes a retaining element 102 and a needle retainer 104. Retaining element 102 is known in the art, and in one embodiment, is a split ring retainer that is intended to hold keys (not shown) or similar hole-bearing members. Alternatively, retaining element 102 is any element that is configured to retain needle retainer 104, in a manner as is described in more detail below.

Needle retainer 104 couples inflating needle 14 to retaining element 102, and includes a body 106 which defines a longitudinally extending opening 108 that extends at least partially through body 106. More specifically, needle retainer 104 includes a sidewall 110 that extends circumferentially from a base 112 to define opening 108 therein. Sidewall 110 includes a plurality of threads 114 such that opening 108 is internally threaded. Opening 108 has an inner diameter 120 that is slightly larger than inflating needle fitting diameter 56, and as such opening 108 is sized to threadably couple with inflating needle fitting 54

Needle retainer 104 also includes an opening 126 which extends through retainer 104 and is transverse with respect to a longitudinal axis of symmetry 128 of retainer 104. Opening 126 enables needle retainer 104 to couple with retaining element 102 such that element 102 extends through retainer opening 126 when retainer 104 is coupled to element 102.

During use, in the exemplary embodiment, needle retainer 104 is coupled to retaining element 102. Inflating needle 14 is then threadably coupled to needle retainer 104, such that retainer 104 couples needle 14 to element 102. In an alternative embodiment, needle retainer 104 is initially coupled to needle 14 and then coupled to element 102. Accordingly, retainer assembly 100 facilitates preventing people from misplacing inflating needles 14, while also providing a convenient and reliable means of transporting inflating needles 14 from one location to another in a vehicle (not shown) such that inadvertent damage to inflating needle shanks 40 is reduced in reliable and cost-efficient means in comparison to needles carried in clothing pockets (not shown).

Figure 4:
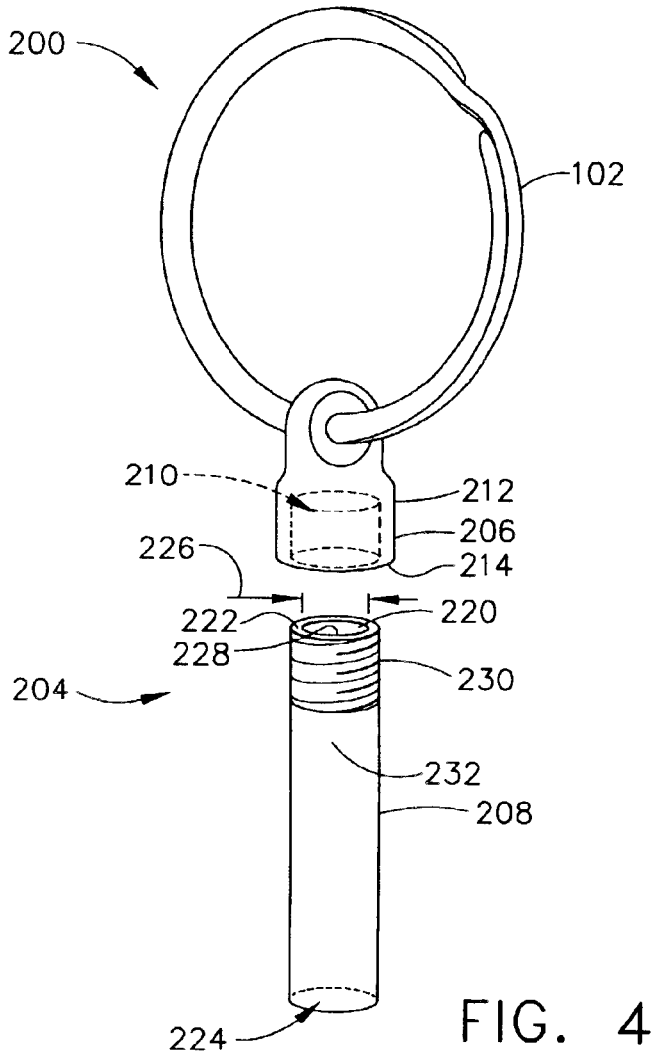
FIG. 4 is a perspective view of an alternative embodiment of a retainer assembly that may be used to retain the inflating needle shown in FIG. 2.

FIG. 4 is a perspective view of an alternative embodiment of a retainer assembly 200 that may be used to retain an inflating needle, such as inflating needle 14. Retainer assembly 200 includes retaining element 102 and a needle retainer 204. Needle retainer 204 couples inflating needle 14 to retaining element 102, and includes an end member 206 and a tubular body 208. End member 206 defines a longitudinally extending opening 210 that extends at least partially through end member 206. More specifically, end member 206 includes a sidewall 212 that extends circumferentially from a base 214 to define opening 210 therein. Sidewall 110 includes a plurality of threads (not shown) such that opening 210 is internally threaded. Opening 210 has an inner diameter (not shown) that is larger than inflating needle fitting diameter 56.

Tubular body 208 is substantially cylindrical and defines a cavity 220 that extends from an upper end 222 of body 208 to a base 224 of body 208. Cavity 220 has a diameter 226 measured with respect to an inner surface 228 of body 208. Cavity diameter 226 is larger than inflating needle fitting diameter 56 such that cavity 220 is sized to receive inflating needle 14 therein. Body upper end 222 includes a plurality of threads 230 extending over an exterior surface 232 of body 208 from body upper end 222 towards body base 224. Threads 230 enable body 208 to threadably couple to end member 206 such that cavity 220 is substantially sealed.

During use, in the exemplary embodiment, needle retainer 204 is coupled to retaining element 102. Inflating needle 14 is then inserted within tubular body 208 and body 208 is then threadably coupled to end member 206 such that needle retainer cavity 220 is substantially sealed. Accordingly, retainer assembly 200 facilitates preventing people from misplacing inflating needles 14, while also providing a convenient and reliable means of transporting inflating needles 14 from one location to another in a vehicle (not shown) such that inadvertent damage to inflating needle shanks 40 is reduced in reliable and cost-efficient means in comparison to needles 14 carried in clothing pockets (not shown).

Figure 5:
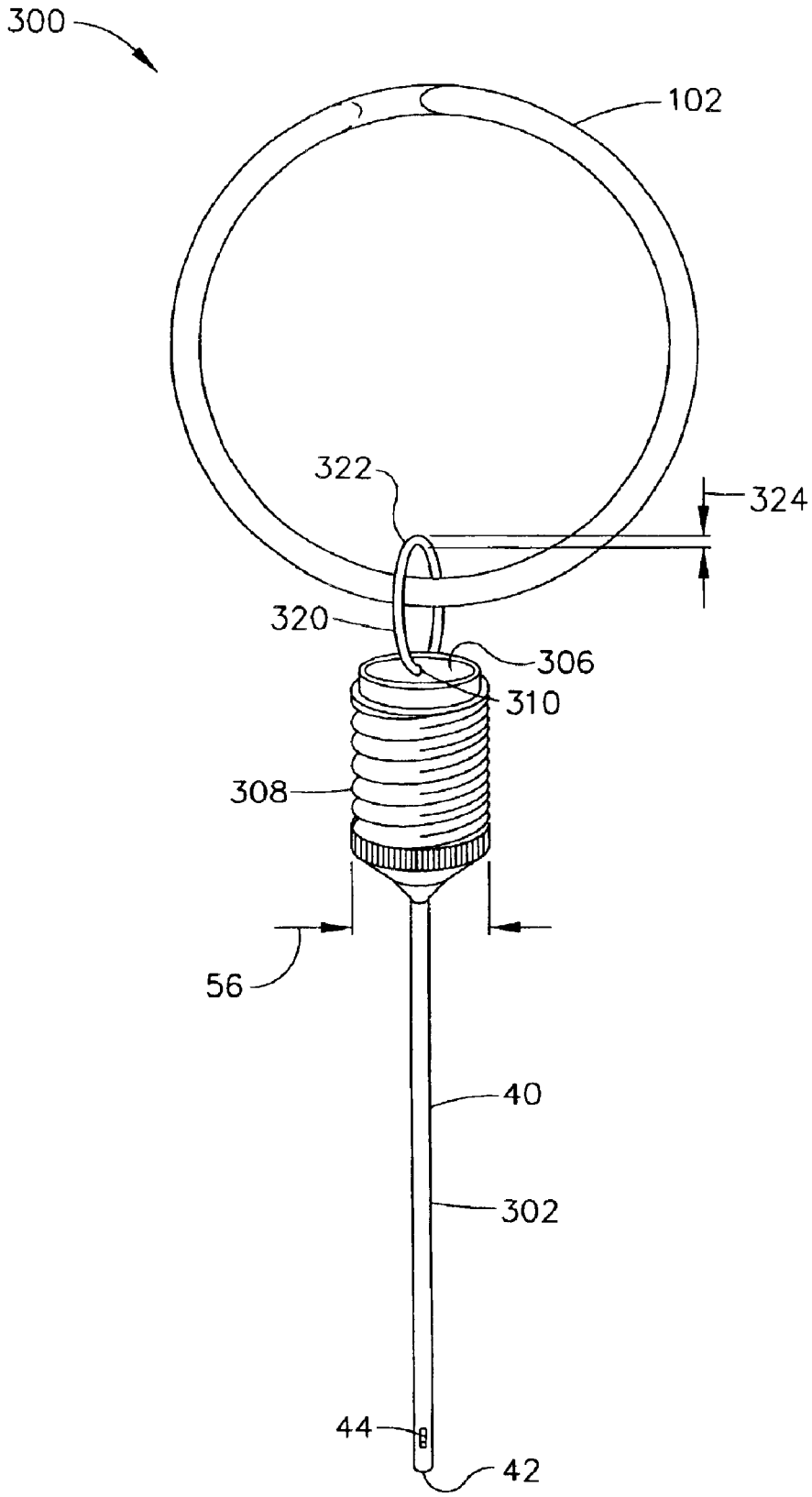
FIG. 5 is a perspective view of a further alternative of a retainer assembly that may be used to retain the inflating needle shown in FIG. 2.

FIG. 5 is a perspective view of a further alternative of a retainer assembly 300 used to retain an inflating needle 302. Inflating needle 302 is substantially similar to inflating needle 14 (shown in FIG. 2) and components of needle 14 that are identical to components of inflating needle 302 are identified in FIG. 5 using the same reference numerals used in FIG. 2. Accordingly, needle 302 includes shank 40, terminal end 42, and discharge opening 44. Additionally, an upper end 306 of shank 40 is opposite terminal end 42 and is provided with an externally threaded fitting 308 having outer diameter 56. Fitting 308 is substantially similar to fitting 54 (shown in FIG. 2), but also includes an opening 310 that extends through a sidewall portion 312 of fitting 308. In an alternative embodiment, opening 310 extends diametrically through fitting 308. Opening 310 is transverse with respect to the longitudinal axis of needle 302.

Retainer assembly 302 includes retaining element 102 and a needle retainer 320. In an alternative embodiment, retaining element 102 is a substantially solid member and needle retainer 320 is a split ring element. Needle retainer 320 facilitates coupling inflating needle 302 to retaining element 102, and is fabricated from a wire-like member 322 formed in a ring. Member 322 has a diameter 324 that is smaller than a cross-sectional diameter 326 of retaining element 102. More specifically, member diameter 324 is slightly smaller than a diameter 330 of fitting opening 310. Accordingly, fitting opening 310 is sized to receive member 322 therethrough.

During use, in the exemplary embodiment, needle retainer 320 is coupled to inflating needle 302 such that member 322 extends through needle fitting opening 310. Needle retainer 320 is then coupled to retaining element 102, such that needle 302 is coupled to retaining element 102. Accordingly, retainer 320 facilitates preventing people from misplacing inflating needles 302, while also providing a convenient and reliable means of transporting inflating needles 302 from one location to another in a vehicle (not shown) such that inadvertent damage to inflating needle shanks 40 is reduced in reliable and cost-efficient means in comparison to needles 14 carried in clothing pockets (not shown).

The above-described inflating needle retaining assembly is cost-effective and highly reliable. The retaining assembly enables an inflating needle to be coupled to a retaining element that is intended to hold keys (not shown) or similar hole-bearing members. Accordingly, as inflating needles are transported from one location to another, it is not necessary to store the needle in a clothing pocket where inadvertent damage to the needle may easily occur. Furthermore, the retaining assembly provides a storage location for the inflating needles that facilitates preventing people from misplacing the inflating needles.

Exemplary embodiments of inflating needle retaining assemblies are described above in detail. The assemblies are not limited to the specific embodiments described herein, but rather, components of each assembly may be utilized independently and separately from other components described herein.

While the invention has been described in terms of various specific embodiments, those skilled in the art will recognize that the invention can be practiced with modification within the spirit and scope of the claims.

What is claimed is:

1. An inflating needle assembly comprising:

a retaining element configured to retain at least one member having an opening extending therethrough;

an inflating needle comprising a hollow shank extending from a threaded fitting; and a retainer coupled to said retaining element for securing said inflating needle to said retaining element, wherein said retainer comprises an opening extending therethrough that is transverse with respect to a longitudinal axis of said retainer and sized to receive said retaining element therethrough.

2. An inflating needle assembly in accordance with claim 1 wherein said retainer comprises an annular wall, said wall defining an internally-threaded opening therein, said threaded opening for threadingly coupling with said inflating needle threaded fitting.

3. An inflating needle assembly in accordance with claim 1 wherein said inflatable needle further comprises an opening extending through said threaded fitting, said opening for receiving said retainer therethrough.

4. An inflating needle assembly comprising:

a retaining element configured to retain at least one member having an opening extending therethrough;

an inflating needle comprising a hollow shank extending from a threaded fitting; and a retainer coupled to said retaining element for securing said inflating needle to said retainer, wherein said retainer comprises an end portion and a tubular body removably coupled to said end portion.

5. An inflating needle assembly in accordance with claim 4 wherein said retainer body is hollow and defines a cavity therein, said retainer body cavity sized to receive said inflating needle therein.

6. An inflating needle assembly comprising:

a retaining element configured to retain at least one member having an opening extending therethrough;

an inflating needle comprising a hollow shank extending from a threaded fitting and an opening extending through at least a portion of said threaded fitting that is tranverse with respect to a longitudinal axis of said retainer and sized to receive said retaining element therethrough; and a retainer coupled to said retaining element for securing said inflating needle to said retainer element.

7. An inflating needle assembly in accordance with claim 6 wherein said retainer comprises a split ring element.

* * * * *